United States Patent [19]

Royer

[11] 4,223,967

[45] Sep. 23, 1980

[54] TELESCOPIC STRUCTURAL ELEMENT FOR MAKING MODULAR CLOSETS, PARTITION WALLS, DOOR SUPPORTS AND THE LIKE

[76] Inventor: Antonio Royer, 601 Wolfe St., Mont St. Hilaire, Quebec, Canada, J3H 2P2

[21] Appl. No.: 904,391

[22] Filed: May 10, 1978

[51] Int. Cl.[2] ..... A47B 55/00

[52] U.S. Cl. ..... 312/245; 312/204; 312/205; 312/257 A

[58] Field of Search ..... 52/122, 238, 241, 243, 52/511, 67, 632, 239, 285, 264; 312/204, 257 SM, 257 A, 257 R, 245, 205

[56] References Cited

U.S. PATENT DOCUMENTS

| | | | |
|---|---|---|---|
| 1,724,821 | 8/1929 | Bohnsack | 52/238 |
| 2,056,328 | 10/1936 | Price | 52/243 |
| 2,563,886 | 8/1951 | Taylor | 52/67 |
| 2,855,037 | 10/1958 | Stiffel | 52/238 |
| 2,958,403 | 11/1960 | Robertson | 52/264 |
| 3,832,810 | 9/1974 | Johnston | 52/67 |
| 3,834,092 | 9/1974 | Whisson | 52/36 |
| 3,998,018 | 12/1976 | Hadges | 52/511 |
| 4,123,879 | 11/1978 | Blodee | 52/36 |

FOREIGN PATENT DOCUMENTS

| | | | |
|---|---|---|---|
| 2123726 | 11/1972 | Fed. Rep. of Germany | 52/238 |
| 1151649 | 2/1958 | France | 52/264 |
| 859024 | 1/1961 | United Kingdom | 52/238 |

*Primary Examiner*—Price C. Faw, Jr.
*Assistant Examiner*—Henry E. Raduazo

[57] ABSTRACT

A modular closet is disclosed which is made of prefabricated standard units adapted to be assembled on the home building site. The units include separate floor, side walls, back wall, ceiling and lintel units and the wall units are provided with telescopic structural elements extending up to the ceiling of the room and permitting the adjustment of the modular closet against the ceiling of rooms of various heights. The installed closet becomes a permanent part of the walls of the room and its exposed structural elements form a backing for conventional wall panels.

4 Claims, 9 Drawing Figures

TELESCOPIC STRUCTURAL ELEMENT FOR MAKING MODULAR CLOSETS, PARTITION WALLS, DOOR SUPPORTS AND THE LIKE

This invention relates to prefabricated modular closets which may fit tightly between floor and ceilings of rooms of various heights.

BACKGROUND OF THE INVENTION

The structural elements and well panels needed to make closets such as wardrobes are generally cut and fitted in situ one with the other and between floor and ceiling. This operation is time-consuming. Therefore, in order to reduce the cost, it has been previously proposed to make prefabricated standard units which are assembled in situ. The main problem with these units is that they require tools for their assembly, that they cannot possibly be made to suit rooms of various heights between floor and ceiling and that they require finishing work.

BRIEF DESCRIPTION OF THE INVENTION

It is therefore the object of the present invention to provide a prefabricated closet which can be assembled in situ and which would fit between floor and ceiling of rooms of various heights, in a minimum amount of time without the use of tools and using less skilled personnel since no finishing work is required.

The modular closet in accordance with a preferred embodiment of the invention, consists of prefabricated floor, ceiling and wall units which are assembled together in situ and form the walls of the enclosure with external frames forming a backing adapted to receive standard wall panels for the rooms. Telescopic structural units are also provided to permit the closet to extend up to the ceiling, so as to allow for adjustment of the closet to fit rooms of various heights and serving as a backing for standard wall panels.

The floor, ceiling and wall units are secured together by means of a special clip. To that effect, the structural elements are generally hollow and have a longitudinal opening, of substantial width, extending the full length thereof, and the clip has legs which are adapted to be inserted into the opening of the telescopic structural element with a snap action.

BRIEF DESCRIPTION OF THE DRAWINGS

The invention will now be disclosed, by way of example, with reference to a preferred embodiment thereof illustrated in the accompanying drawings, in which:

Referring to FIGS. 1–9, there is shown a modular closet to be incorporated within the walls of a house and consisting generally of a floor unit 10, side wall units 12, 14, back wall unit 16 and ceiling unit 18. The floor unit 10 is preferably made of a sheet of clapboard material, although other materials can also be used. Similarly, the ceiling unit 18 is preferably made of a sheet of pressed wood chips; but other material can also be utilized. The side and back wall units 12, 14, and 16 are each made up of a rectangular frame consisting of metallic structural elements 20, which are secured by any suitable means to transverse top and bottom structural elements 22 and 24. A sheet of gyproc, or any other suitable panel, is secured to the inside surface of the frame.

Figure 4:
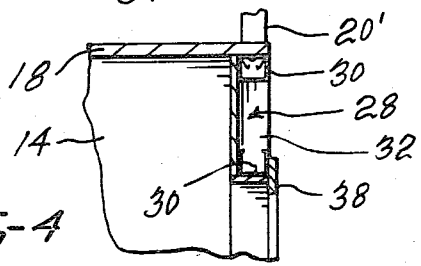
FIG. 4 illustrates a section view taken along line 4—4 of FIG. 1.

A lintel unit 28 is mounted across the top front of the modular closet. Lintel unit 28 consists of a frame formed transverse metallic structural elements 30 and upright structural elements 32. A panel (see FIG. 4) is secured to the inside surface of the frame of the lintel unit. Swivel doors 34 close the front of the modular closet. As commonly known, such doors are of standard size and the dimensions of the closet are such as to match the size of the doors. A wooden stud 36, covered on the inside with a sheet 37 of masonite, or any other suitable material, is secured on each side of the doors between lintel unit 28 and floor unit 10 to fill the space between the side walls and the doors.

Finally, a molding 38 is secured to the edge of the stud 36 and the lintel unit 28.

Although not absolutely necessary, the inside of the modular closet in accordance with the invention is made of masonite, or other equivalent material, to provide a permanent interior finish, which will not require repainting.

Figure 5:
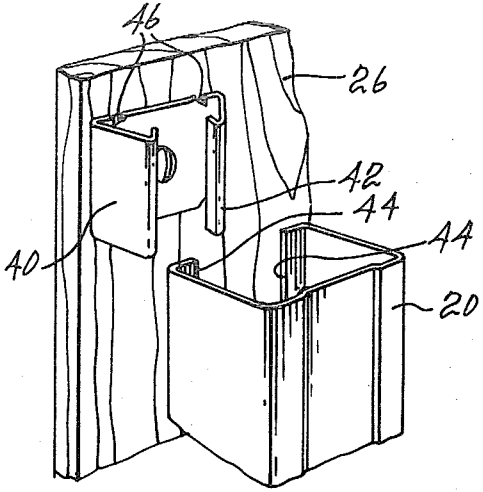
FIG. 5 illustrates a perspective view of the clip used for securing the various units of the modular closet together.
Figure 6:
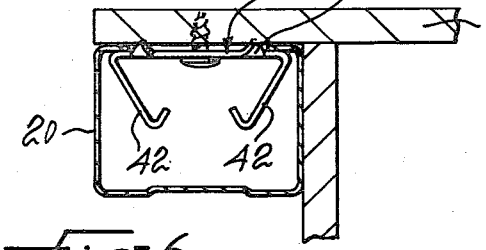
FIG. 6 illustrates a section view through the clip of FIG. 5 when a structural element is assembled thereto.

Each of the above-disclosed units is prefabricated and assembled in situ by means of special clips 40, more clearly shown in FIGS. 5 and 6. The clip 40 is generally U-shaped with turned-in outwardly converging legs 42. Structural elements 20 are hollow having a U-shaped cross-section and provided with inwardly directed lips 44 defining a longitudinal opening extending the full length the element to permit insertion of the legs 42 of the clip. The flat portion of the clip 40 is also provided with turned-out ears 46, which permit attachment of the clip to the back walls, the floor and ceiling units with a predetermined space between the unit and the clip. During assembly of the units, the walls of the structural element open up slightly and the lips 44 slide around the corners of the clip and snap back into position in the space between the clip and the units.

The units are assembled in the following order.

The floor unit 10 is secured to the floor of the room. Then using clips 40, the back wall unit is secured to the floor unit 10 and the left and right side wall units, with the moldings 38 attached thereto, are secured to the back wall unit and to the floor unit. The lintel unit 28 is finally secured to the front of the closet. The panels of the units 12, 14 and 28 together with floor unit 10 and ceiling unit 18 form the surfaces of the enclosure defined by the assembled closet. The ceiling of the enclosure is at a lower height than the ceiling of the room in which the closet is installed.

Figure 2:
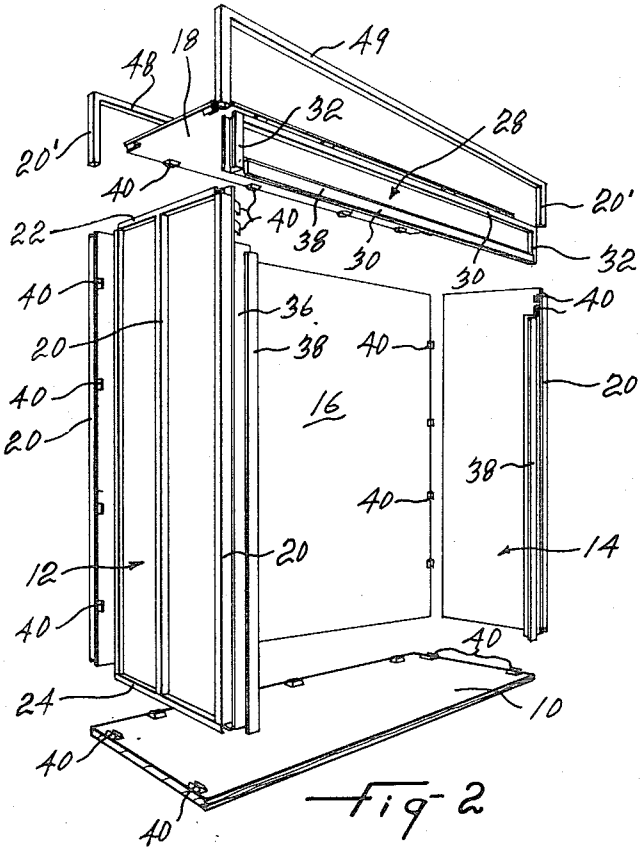
FIG. 2 illustrates an exploded view of the components of the modular closet of FIG. 1.
Figure 1:
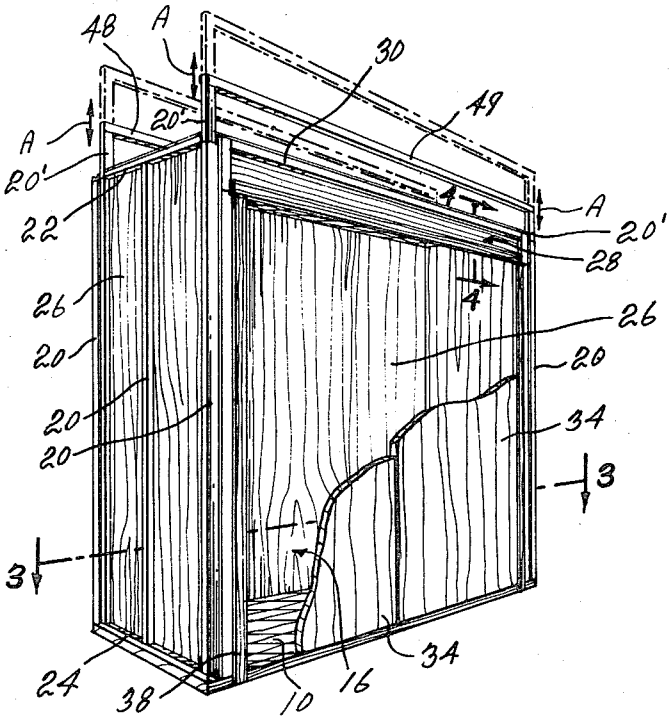
FIG. 1 illustrates a perspective view of a modular closet in accordance with the invention.
Figure 3:
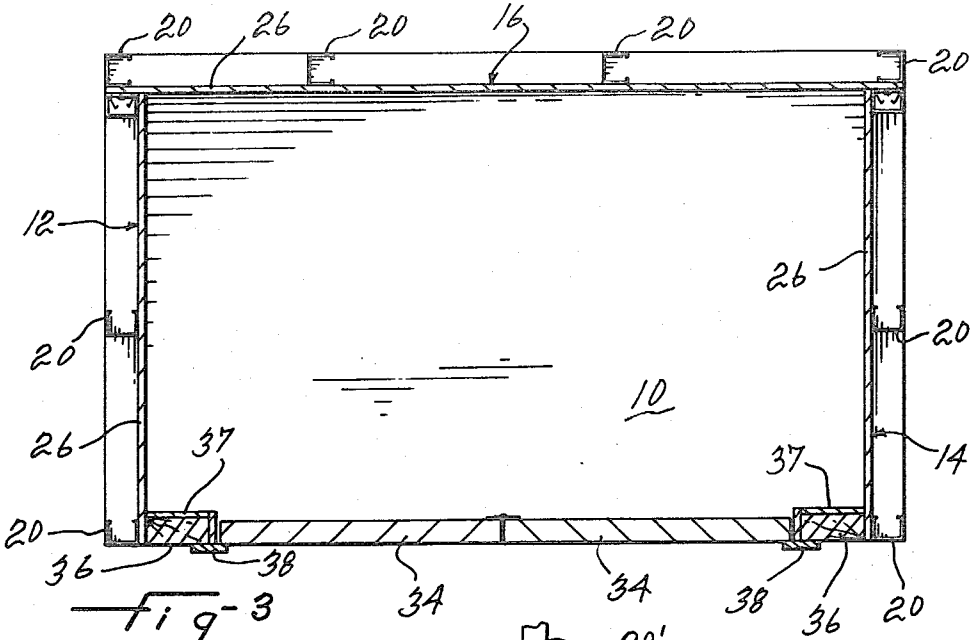
FIG. 3 illustrates a section view taken along line 3—3 of FIG. 1.
Figure 7:
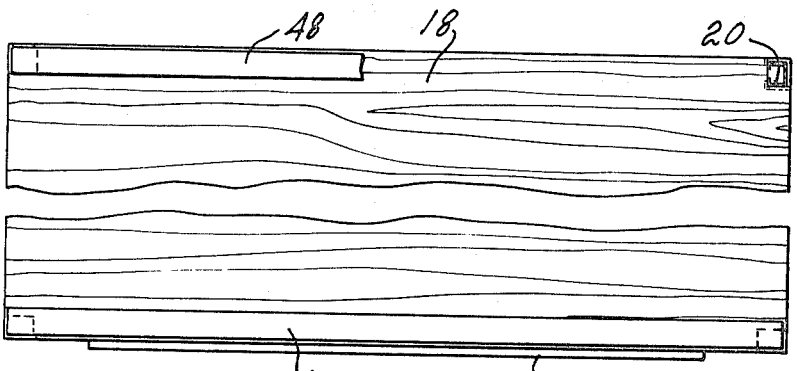
FIG. 7 illustrates a top view of the modular closet of FIG. 1.
Figure 8:
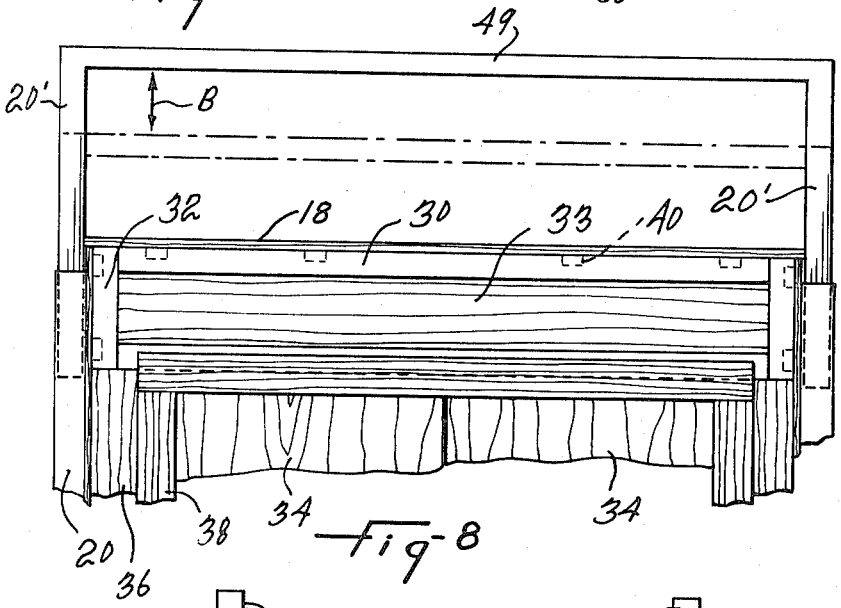
FIG. 8 illustrates a front elevational view of the modular unit of FIG. 1.
Figure 9:
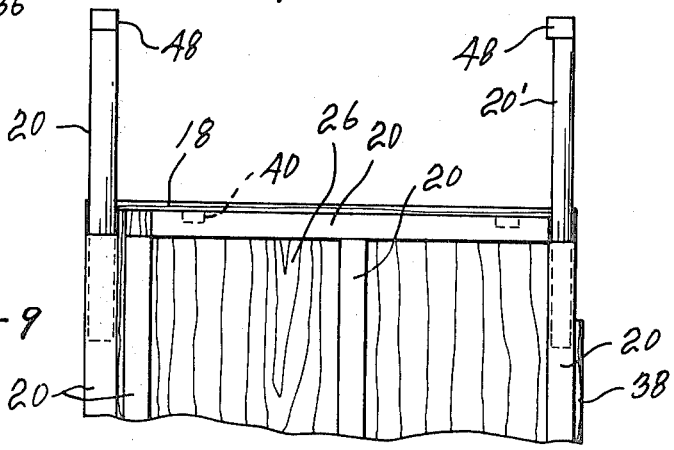
FIG. 9 illustrates a side elevational view of the modular unit of FIG. 1.

Referring now to FIGS. 1 and 2, and more particularly to FIGS. 7–9, the end structural elements 20 of the back wall unit 16, as well as the front structural elements 20 of the side wall units, telescopically receive the legs 20' of inverted U-shaped telescopic units. The back telescopic unit includes a transverse member 48 secured to the two legs 20', while the front telescopic unit includes a transverse member 49 secured to two legs 20'. The two telescopic units are extended up and secured to the ceiling of the room, as shown by arrow A of FIG. 1.

The afore-mentioned modular closets may be installed on an outside wall or for part of a partition wall in the same manner as the conventional closets, except that they can be installed in a much shorter period of time by relatively unskilled labor. The exposed frames of the back wall unit, the side wall units, the lintel unit and the telescopic units serve as a backing for fixing thereto standard wall panels such as gyproc wall panels. A transverse member 60 is secured to the structural elements at a height corresponding to the height of the door and another telescopic structural element 62 is secured between ceiling rail 58 and transverse member 60.

Figure 10:
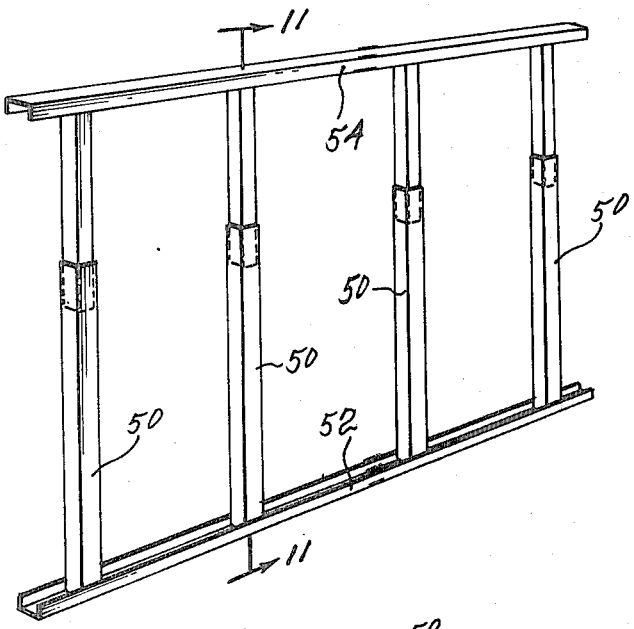
Figure 12:
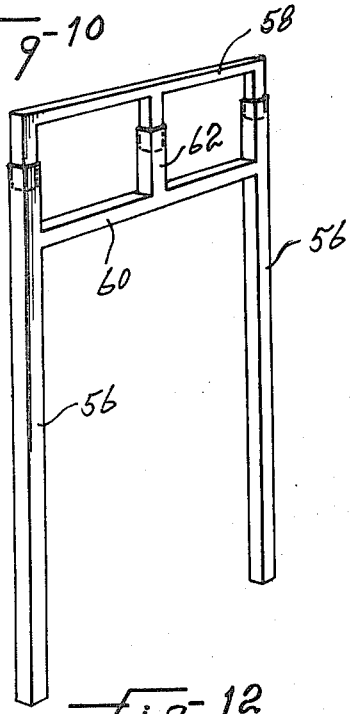
Figure 11:
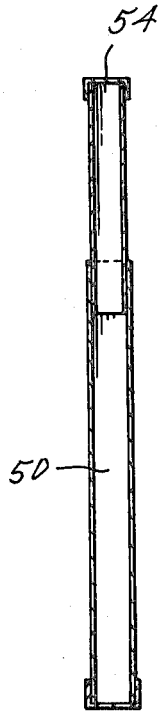

Rails 52 and 54 of FIG. 10, or rail 58 of FIG. 12, can have the profile of element 20 and positioned with the longitudinal opening facing the ceiling or floor and secured thereto by clips 40, as shown by bottom rail 24 in FIG. 2.

Figure 14:
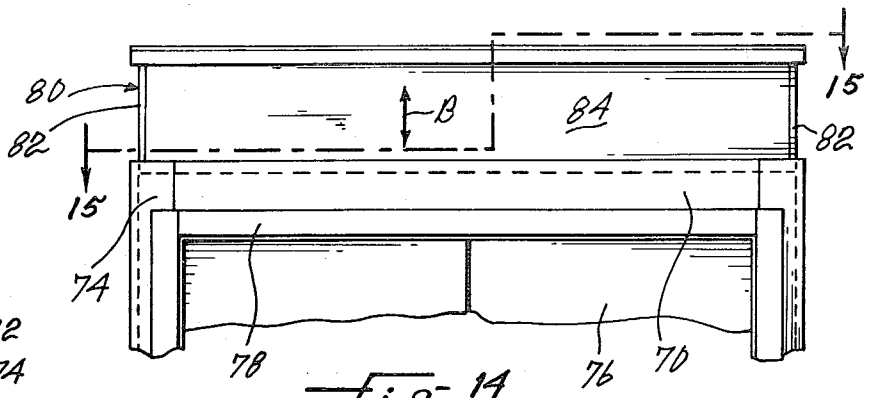
Figure 15:
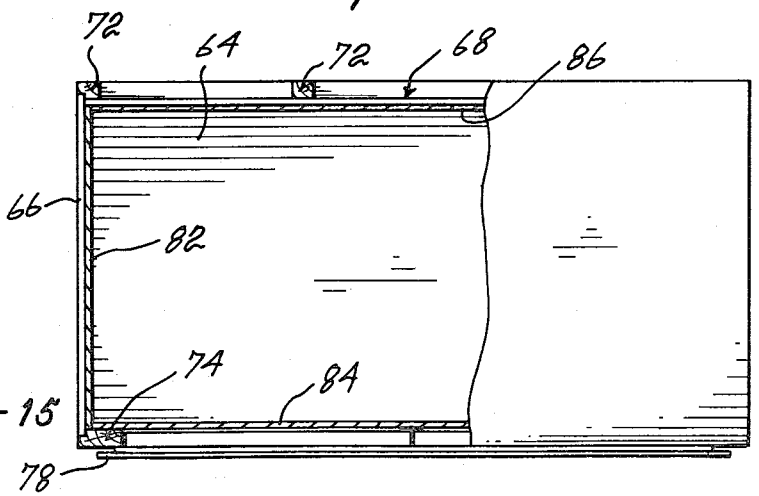
Figure 13:
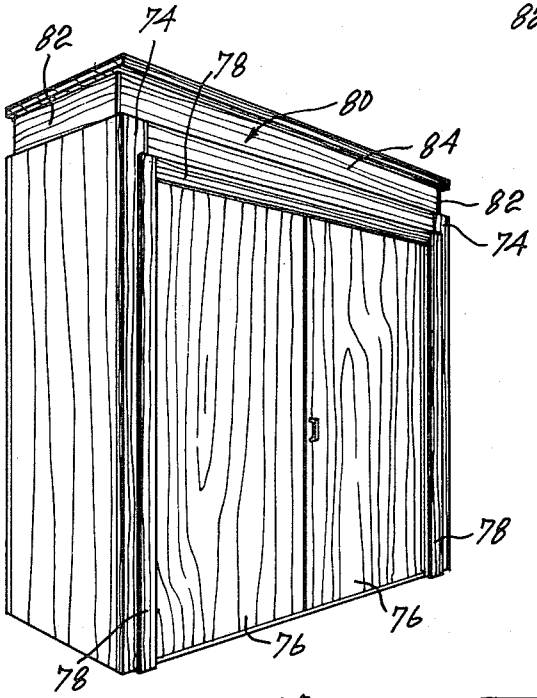

Referring now to FIGS. 13–15, there is shown another embodiment of a modular closet in accordance with a further embodiment of the invention and made of wood. It comprises a floor unit 64, two side wall units 66, a back wall unit 68 and a lintel unit 70. Units 66 and 68 include upright wooden structural ements 72 and 74. The front lintel unit is secured to wooden structural elements 74. The side wall units are secured to structural elements 72 and 74. The front of the closet is closed by doors 76 and a molding 78 is placed all around the door. The top of the closet is closed by a telescopic unit comprising a ceiling unit 80 and side, front and back walls 82, 84, and 86, respectively, secured to the ceiling unit. The telescopic walls make a tight sliding fit into the main body of the closet and may be extended, as shown by arrow B in FIG. 14, to allow perfect fit of the prefabricated closet against the ceiling of the room where it is installed.

Although the invention has been disclosed with reference to various embodiments, it is to be understood that it could possibly be used in other locations where extensible structural elements could be utilized to save time and labor cost.

What I claim is:

1. A prefabricated modular closet for permanent installation in a room, comprising several separate units adapted to be permanently secured together to form an enclosure with a front opening, said units including a floor unit, two side wall units, a back wall unit, a ceiling unit, a front lintel unit and a back and a front telescopic unit, said floor unit and ceiling unit consisting of a flat floor panel and flat ceiling panel respectively, said side wall units, said back wall unit and said lintel unit each consisting of a structural frame with a flat panel secured to one face of said frame, said telescopic units each consisting of an inverted U-shaped frame defining a top transverse member and depending legs; snap action clip means for securing said floor panel to the underside of the frames of said back wall unit and of said side wall units, for securing said ceiling panel to the top side of said back wall unit, of said side wall units and of said lintel unit, and for securing said back wall unit to said side wall units, said back wall unit, said side wall units and said lintel unit, when assembled by said clip means and positioned in a room having their respective panels together with the floor panel and ceiling panel defining the surfaces of said enclosure, with said ceiling panel spaced below the ceiling of the room, the frames of said last named units being located on the outside of said enclosure, the legs of said telescopic units telescopically engageable with said frames at the front and back of said enclosure, said top transverse members adapted to be secured to the ceiling of the room and said floor panel adapted to be secured to the floor of the room, the external surface of the frames of said telescopic units, of said lintel unit, of said back wall unit and of said side wall units forming a backing for securing wall panelling thereto.

2. A prefabricated modular closet as defined in claim 1, wherein said frames include structural elements of U-shaped crosssection and having inwardly directed lips defining the opening of the U shape of said elements, and said clip means includes clips having a base secured to the respective units, ears projecting from the inside face of said base and engaging the units to define a space between the units and the base, and outwardly converging legs depending from the base and projecting from the outside face of said base, said legs engageable into the opening of said structural elements and the lips snapping back into said space.

3. A prefabricated modular closet as defined in claim 2, wherein some of said clips are secured to said floor panel, to said ceiling panel and to the panel of said back wall unit and engageable with facing structural elements of those others of said units to be fastened to said floor panel, to said ceiling panel and to said back wall unit, while others of said clips serve to secure said side wall units to said lintel unit.

4. A prefabricated modular closet as defined in claims 1, 2 or 3, wherein said legs of said front and back telescopic units telescopically engage the frames of said side wall units and the frame of said back wall unit respectively.

* * * * *